United States Patent [19]

Wagner

[11] 4,010,764

[45] Mar. 8, 1977

[54] SIDEBURN TRIMMING GUIDE

[76] Inventor: Stan Wagner, 880 Van St., London, Ontario, Canada

[22] Filed: May 10, 1976

[21] Appl. No.: 684,584

[52] U.S. Cl. ..... 132/45 R

[51] Int. Cl.[2] ..... A45D 24/36

[58] Field of Search ..... 132/45 R, 7, 9; 33/174; 128/348; 30/233.5

[56] References Cited

UNITED STATES PATENTS

| | | | |
|---|---|---|---|
| 2,786,477 | 3/1957 | Cohen | 132/45 R |
| 2,949,920 | 8/1960 | Humphrey | 132/45 R |
| 3,459,197 | 8/1969 | Wilson | 132/45 R |

*Primary Examiner*—G.E. McNeill

*Attorney, Agent, or Firm*—Robert D. Farkas

[57] ABSTRACT

A sideburn trimming guide comprising a flexible arcuate inwardly biased band element adapted to be placed over the top portion of the user's head, the free ends of the band element falling adjacent to the user's sideburns, first adjusting means for adjusting the length of the band element, a pair of guide means each movably secured to a free end of the band element and adapted to rest on the user's sideburns, second adjusting means for adjusting the position of the guide means on the band element, a pair of positioning elements fixedly secured to the band element and adapted to rest on the user's ears, and illuminating means adapted to illuminate the user's sideburns adjacent to the guide means.

7 Claims, 4 Drawing Figures

SIDEBURN TRIMMING GUIDE

BACKGROUND OF THE INVENTION

1. Field of the Invention

The present invention relates to devices for gauging the proper length of the user's sideburns and guiding the cutting thereof, and more particularly, to a sideburn trimming guide which affixes over the user's head and provides means for illuminating the sideburns during cutting.

2. Description of the Prior Art

In the past the problem of trimming both sideburns to the same length and at the same angle has been substantial. Properly trimmed sideburns speak well of the wearer and contribute to an overall neat appearance. The need for sideburn trimming guides has been recognized in the prior art, however, proposed guides have offered a limited degree of adjustability, haphazard positioning, and difficulty in the user seeing the guide edges provided.

U.S. Pat. No. 1,812,443 issued to F. Mason on June 30, 1931 discloses a shaving guide which includes a flexible band placed over the user's head, a perforated bracket guide affixed to one end of the band and a rod element adapted to be inserted in the perforations and placed on the user's ear thereby positioning the guide edge of the bracket guide at stepped positions on the user's sideburns.

U.S. Pat. No. 2,786,477 issued to J. Cohen on Mar. 26, 1957 teaches a sideburn cutting gauge which includes a U-shaped member having a bubble level affixed thereon, a pair of guide elements affixed to the free ends of the U-shaped member, and a support strap adapted ti circumscribe the back of the user's head.

The present invention overcomes the shortcomings in the prior art by providing a sideburn trimming guide which is continuously adjustable, includes means for positive placement and means for illuminating the guide edge thereof.

SUMMARY OF THE INVENTION

Therefore, it is a primary object of the present invention to provide a sideburn trimming guide which is continuously adjustable for different length sideburns and various shaped and sized heads.

A further object is to provide a sideburn trimming guide which is easily and quickly positioned on the head of the user.

Another object is to provide a sideburn trimming guide which illuminates the user's sideburns thereby facilitating trimming.

These objects, as well as further objects and advantages, of the present invention will become readily apparent after reading the description of a non-limiting illustrative embodiment and the accompanying drawing.

The present invention provides a sideburn trimming guide which may be used as a guide for razors, or the like, to neatly and evenly trim sideburns. The present invention is adjustable for different length sideburns, and various size heads. A sideburn trimming guide constructed according to the principles of the present invention includes a flexible arcuate inwardly biased band element which is adapted to be placed over the top portion of the user's head. When placed over the user's head the free ends of the band element rest in front of, and adjacent to, the user's ears. First adjusting means for adjusting the length of the band element for different size and shaped heads is provided. One of each of a pair of guide plates are movably secured to each of the free ends of the band element and are adapted to rest on the user's sideburns. Second adjusting means are provided for adjusting the position of the guide means on the band elements relative to the user's ears. Each of a pair of positioning elements are affixed on one of the free ends thereof to the band element on a portion thereof adjacent to the ears of the user. The portion of the positioning elements adjacent to the other free ends thereof are adapted to rest on the user's ears thereby positioning the free ends of the band element at a fixed distance therefrom. Illumination means are provided adapted to illuminate the user's sideburns adjacent to the guide means.

BRIEF DESCRIPTION OF THE DRAWINGS

In order that the present invention may be more fully understood it will now be described, by way of example, with reference to the accompanying drawings in which.

DESCRIPTION OF THE PREFERRED EMBODIMENT

Figure 1:
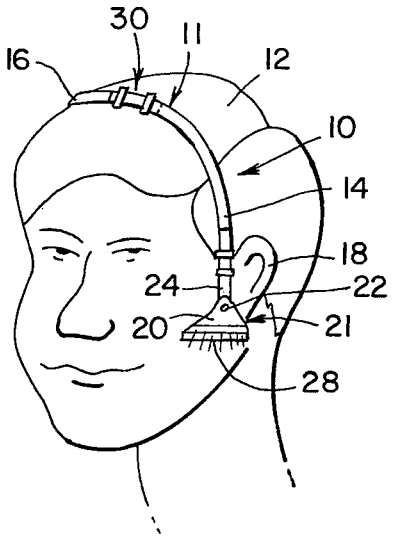
FIG. 1 illustrates a perspective view of the preferred embodiment of the present invention in place on the user's head.

Referring now to the figures, and more particularly to FIG. 1, there is illustrated therein a sideburn trimming guide 10 which includes a flexible arcuate inwardly biased band element 11 which is adapted to be placed over the top portion of a user's head 12. When placed on the user's head 12 as shown, the free ends 14 and 16, 16 not shown, rest in front of and adjacent to the ears 18 of the user. A pair of guide means 21 in the form of a pair of substantially triangularly shaped plates 20 each pivotly secured at the vertex 22 thereof to an arm element 24. The base of plates 20 opposite the vertex 22 provides a straight guide edge 28 adapted to guide a cutting implement such as a razor or the like positioned adjacent to the guide edge 28.

Figure 2:
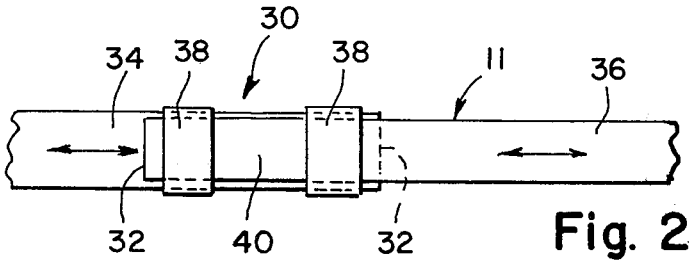
FIG. 2 illustrates a top view of a portion of the embodiment shown in FIG. 1.

FIG. 2 illustrates a first adjusting means 30 for adjusting the length of the band element 11. The first adjusting means 30 preferably includes a severance 32 which bifurcates the band element 11 into a first portion 34 and a second portion 36 thereof. A plurality of first clamp elements 38 are fixedly secured to teh first portion 34 and are adapted to slideably and frictionally retain the end portion 40 of the second portion 36 therein. The second portion 36 is positioned in an overlaying relationship with the first portion 34 and is extensive thereto. The positioning of the second portion 36 in relation to the first portion 34 may be varied to accommodate various size and shaped heads.

Figure 3:
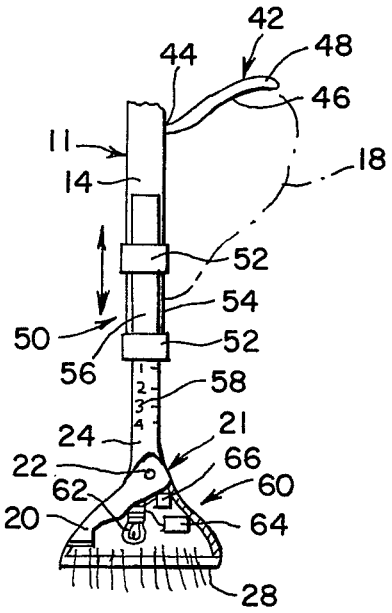
FIG. 3 illustrates an elevation view of the preferred embodiment partially broken away.

FIG. 3 illustrates a positioning element 42 which is preferably contoured to conform to the user's ear 18 and is affixed on one free 44 thereof to the band element 11. A portion 46 of the positioning element 42 adjacent the outer free end 48 thereof is adapted to rest on the user's ear 18 adjacent thereto thereby positioning the free end 14 of the band element 11 at a fixed distance relative to the ears 18. A similar positioning element 42 is provided adjacent to the free end 16 not shown.

Second adjusting means 50 for adjusting the position of the guide means 21 on the band element 11 is provided. The second adjusting means 50 includes a plurality of second clamp elements 52 which are fixedly secured to the portion 54 of the band element 11 adjacent to the free ends 14 and 16, 16 not shown, thereof. The second clamp elements 52 on each of the free ends 14 and 16, 16 not shown, are adapted to slideably and frictionally retain the end portion 56 of one of the arm elements 24 therein. Arms 24 are positioned in an overlaying relationship relative to the portion 54 adjacent to the free ends 14 and 16, 16 not shown, of the band element 11 and are extensive thereto. The arms 24 are provided with suitable indicia 58 to indicate the positioning thereof relative to said band element 11.

Figure 4:
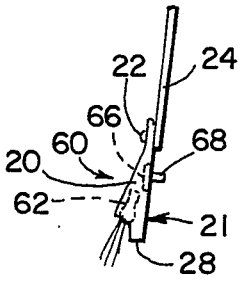
FIG. 4 is a side elevational view of the preferred embodiment shown in FIG. 3.

Illumination means 60 are adapted to illuminate the sideburns of the user adjacent to the guide means 21 as shown in FIG. 4 and are disposed within the plate 21. The illuminating means 60 preferably includes a lamp 62 which partially extends through an aperture disposed in the plate 21, battery 64, and a momentary push button switch 66 also within the plate 21. The push button 68 of the momentary push button switch 66 extends through an aperture disposed in the plate 21, as shown in FIG. 4, and is adapted to be pressed when the sideburn trimming guide 10 is placed on the user's head 12, thereby activating the lamp 62.

It will be understood that various changes in the details, materials, arrangements of parts and operation conditions which have been herein described and illustrated in order to explain the nature of the invention may be made by those skilled in the art within the principles and scope of the invention.

Having thus set forth the nature of the invention, what is claimed is:

1. A sideburn trimming guide comprising:

a flexible arcuate band element for placement on the top portion of the user's head, the free ends of said band element biased inwardly and resting in front of and adjacent to the user's ears;

first adjusting means for adjusting the length of said band element;

a pair of guide means for providing a pair of guide lines for guiding a cutting implement in cutting the user's sideburns, said guide lines spaced a variable distance from the location of said band;

second adjusting means for adjusting the position of said guide lines said variable distance from said band element;

a pair of positioning elements each affixed on one end thereof to said band element adjacent each of said user's ears, the portion adjacent the other ends of said positioning element for resting on said ears positioning said free ends of said band element at a fixed distance relative to said ears; and illumination means attached to said guide means adapted to illuminate said sideburns adjacent said guide lines.

2. The sideburn trimming guide as claimed in claim 1, wherein said first adjusting means comprises the bifurcation of said length of said band element into a first portion and a second portion, a plurality of first clamp elements each having slots therein fixedly secured to the first portion, said first clamp elements for slideably and frictionally retaining part of the length of said second portion within said slots, said second portion overlaying said first portion and partially coextensive therewith.

3. The sideburn trimming guide as claimed in claim 1, wherein said guide means comprise a pair of substantially triangularly shaped plates, each of said triangularly shaped plates pivotly secured at the vertex thereof to an arm, the base of said triangularly shaped plate having a straight guide edge defining said guide line.

4. The sideburn trimming guide as claimed in claim 1, wherein said positioning elements have a contoured surface, said surface for conforming to the user's ear.

5. The sideburn trimming guide as claimed in claim 1, wherein said free ends of each of said arm elements are provided with visible indicia which indicates the relative positioning of said arm to said band element.

6. The sideburn trimming guide as claimed in claim 3, wherein said second adjusting means comprises a plurality of second clamp elements, each of said second clamp elements having slots therein, said second clamp elements fixedly secured to said band element adjacent said free ends thereof, said second clamp elements on each of said free ends for slideably frictionally retaining a captured portion of one of said arms therein, said arms overlaying said band element and partially coextensive thereto.

7. The sideburn trimming guide as claimed in claim 3, wherein said illuminating means comprises a lamp, a battery, a momentary push button switch partially disposed within each of said plates, said lamp partially extending through a first aperture located in said plate, the push button operating said momentary switch extending through a second aperture located in said plate and adapted to be pressed when said sideburn trimming guide is placed on the user's head thereby energizing said lamp.

* * * * *